United States Patent [19]

Reed et al.

[11] 4,245,980

[45] Jan. 20, 1981

[54] BURNER FOR REDUCED NOX EMISSION AND CONTROL OF FLAME SPREAD AND LENGTH

[75] Inventors: Robert D. Reed; Hershel E. Goodnight; Richard R. Martin, all of Tulsa, Okla.

[73] Assignee: John Zink Company, Tulsa, Okla.

[21] Appl. No.: 916,581

[22] Filed: Jun. 19, 1978

[51] Int. Cl.[3] ..... F23M 9/00

[52] U.S. Cl. ..... 431/182; 431/284; 431/351

[58] Field of Search ..... 431/182–184, 431/173, 190, 284, 285, 351, 352

[56] References Cited

U.S. PATENT DOCUMENTS

| | | | |
|---|---|---|---|
| 2,211,684 | 8/1940 | Baker | 431/184 |
| 3,244,220 | 4/1966 | Kloecker | 431/184 |
| 3,649,155 | 3/1972 | Sharan | 431/183 |
| 3,672,808 | 6/1972 | Miyazaki | 431/190 |
| 3,695,817 | 10/1972 | Sharan | 431/182 |
| 3,746,499 | 7/1973 | Guerre et al. | 431/182 |
| 3,748,080 | 7/1973 | Dunn | 431/190 |

*Primary Examiner*—Carroll B. Dority, Jr.

*Attorney, Agent, or Firm*—Head, Johnson & Chafin

[57] ABSTRACT

A burner for reduced NOx emission and also for the control of the shape of the flame as regards its length and spread, comprises a first combustion zone, which is contained within a cylindrical chamber lined with refractory material. A burner tube is inserted through an opening in the upstream end of the first combustion zone, the burner including means for providing and burning liquid and gaseous fuel. A first air plenum is provided upstream of the first combustion zone with means for supplying less-than-stoichiometric combustion air in a tangential swirling manner, prior to entering the first combustion zone. A second air plenum is provided coaxial with and surrounding the first combustion zone and tertiary air is supplied tangentially to this air plenum so that the tertiary air will flow in a helical swirling motion along the outside of the first combustion chamber, around the downstream end of the combustion chamber and will meet and mix with the hot products of combustion from the first combustion chamber. Control of the shape of the flame is provided by controlling the relative directions of tangential flow of air in the two plena.

5 Claims, 5 Drawing Figures

BURNER FOR REDUCED NOX EMISSION AND CONTROL OF FLAME SPREAD AND LENGTH

CROSS-REFERENCE TO RELATED PATENT AND APPLICATION

This invention is related to U.S. Pat. No. 4,004,875, dated Jan. 25, 1977, of John Smith Zink, et al.

It is also related to the copending Application, Ser. No. 916,766, filed June 19, 1978 of Robert D. Reed, entitled "LOW NOx BURNER" filed cotemporaneously with this application.

BACKGROUND OF THE INVENTION

1. Field of the Invention

This invention lies in the field of liquid and gaseous fuel burning. More particularly, this invention concerns fuel burning apparatus in which a minimum value of NOx is provided in the effluent gases.

Still more particularly, this invention is concerned with fuel burning with low NOx and with control of the general shape of the flame as concerns its length and width.

2. Description of the Prior Art

Burning of all fuels is productive of oxides of nitrogen (Nox) in normal operation. Such oxides of nitrogen as are produced in combination with olefinic hydrocarbons, which may be present in the atmosphere, provide a source of smog.

Smog is recognized universally as potentially damaging to animal tissue. Consequently, severe limitations on the Nox content of stack gases vented to the atmosphere as the result of fuels burning, have been imposed by various government authorities and agents.

The prior art is best represented by U.S. Pat. No. 4,004,875. This patent has been the basis of a wide application of low NOx burners. However, when firing rate changes significantly, such as from 100% to 80%, as is typical of daily process heater firing, there is difficulty in maintaining NOx suppression. The reason for this is that, at reduced firing rate, the furnace draft remains constant, or approximately so, and increased air to fuel ratios destroy the less-than-stoichiometric burning zone prior to tertiary air delivery, which results in less-than-optimum NOx reduction, plus higher-than-desirable excess air.

What is required is a burner which provides means for correction of any condition of firing, such as might be required when the furnace draft remains substantially constant while changes in firing rate are made. If such corrections can be made, the result is the continuation of NOx suppression and the maintenance of optimum excess air for high thermal efficiency. In the prior art burner there is no control of the tertiary air, which is caused to flow by furnace draft, while the primary and secondary air also flow for the same reason. The total air flow will vary as the square root of the furnace draft. Thus, only one rate of fuel burning or firing rate, at a condition of furnace draft, will provide required excess air and NOx suppression. This would seem to indicate that control of air flow would provide some benefit.

What is not immediately evident is, that the air entry control must be proportionately controlled for maintenance of a less-than-stoichiometric burning zone prior to entry of tertiary air to the less-than-stoichiometric gases, for completion of fuel burning plus preferred excess air when the firing rate is caused to vary. If the conditions as outlined are maintained, there is suitable NOx suppression in any condition of draft and firing rate and furnace excess air remains best for high thermal efficiency. This is to say that control must be proportional and simultaneous for primary, secondary and tertiary air for best and most assured operation in all firing conditions.

SUMMARY OF THE INVENTION

It is a primary object of this invention to provide a burner for use of liquid and/or gaseous fuel with low NOx in the effluent gases.

It is a further object of this invention to provide low NOx burning for a wide range of fuel burning rates and corresponding air supply rates.

It is also a still further object of this invention to provide low NOx burning in a burner, which can be designed for a type of flame shape that can provide either a long narrow directed flame or a shorter wider diffuse flame.

These and other objects are realized and the limitations of the prior art are overcome in this invention by providing a fuel burner system that includes means for burning of liquid fuels through a first burner and/or gaseous fuels through a second burner into a first combustion zone in which less-than-stoichiometric combustion air is provided. The combustion zone is enclosed in a refractory-lined chamber through which air is supplied around a central opening in one end and in which the burners are inserted axially into the opening.

A first air plenum is provided upstream of the combustion zone and primary and secondary air is supplied to the first plenum in a tangential manner so as to create a swirling flow of primary and secondary combustion air, which proceeds in a helical motion along the first air plenum and through the opening into the combustion zone, thoroughly and turbulently mixing with the fuel so that a swirling helical flame progresses downwardly through and along the first combustion zone.

Tertiary air is supplied to a second combustion air plenum, which surrounds the outer surface of the first combustion zone. Here again, the tertiary air is supplied through a duct which enters the second plenum tangentially so that the tertiary air will progress helically along the second air plenum. As the tertiary air moves toward the downstream end of the first combustion zone, it is deflected radially inwardly to mix with the hot reducing flame emerging from the first combustion zone into a second combustion zone where complete combustion of the combustible gases is completed, providing a low NOx and an efficient combustion.

Means are provided for the atomization of water in the primary and secondary air entering the first air plenum so that the fine water droplets will evaporate and will, in conjunction with the hydrocarbon fuels, provide a combustion chemistry in which the carbon will be partially burned to carbon monoxide and there will be hydrogen and carbon monoxide which will tend to reduce any NOx present in the first combustion chamber.

The air ducts which supply primary and secondary air to the first air plenum and tertiary air to the second air plenum are fitted with dampers or other means for controlling the flow rate of air to the first and second plena. These two air rate controls are controllable simultaneously by a control means which can be responsive to the flow rate of fuel to the burners, for example, so that, as the fuel burning rate changes, the total quantity of combustion air changes proportionately while still maintaining a ratio of primary and secondary combustion air to the first plenum and tertiary air in a specified ratio of the total to the second plenum.

In this way, combustion air can be controlled to maintain always a less-than-stoichiometric air to the first plenum, supplying primary and secondary air to the first combustion zone and providing tertiary air in the proper amount so that the total air flow will be at least as great and slightly greater than stoichiometric air for the combustion of all of the fuel.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

In relation to reduced NOx emission, environmental regulations now require lower NOx emission than is possible by the use of non-specialized burners, such as have been common to the art of burning fuel in industry. It has been determined by experiment that at least 60% reduction in NOx emission is possible through the use of the burner of this invention. Thus, the use of this invention provides opportunity for continued industrial operation, which, in most cases, would be questionable otherwise. However, other factors, such as flame length, and flame shape, are equally demanding in industrial operation, and it is required that the burner be acceptable from both the NOx limitation standpoint, and the flame characteristic standpoint. This burner, through the facility it provides for flow direction and velocity selection factors, provides means for meeting both requirements.

Figure 1:
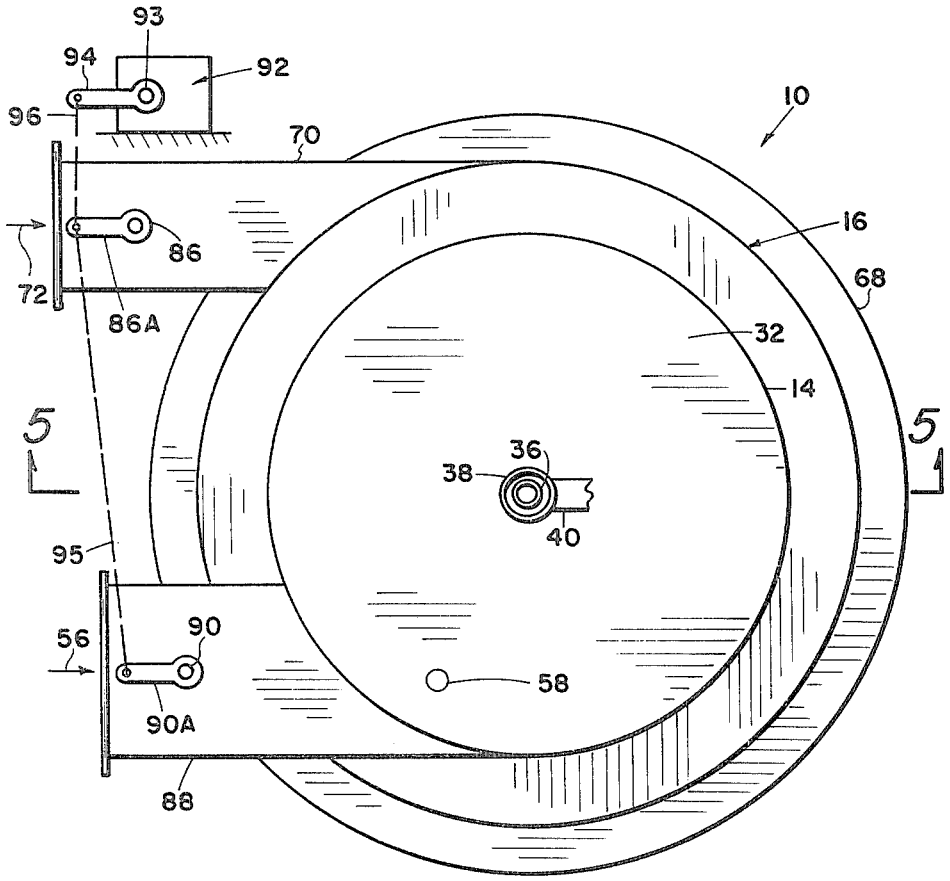
FIG. 1 illustrates an end elevation of one embodiment of this invention.
Figure 2:
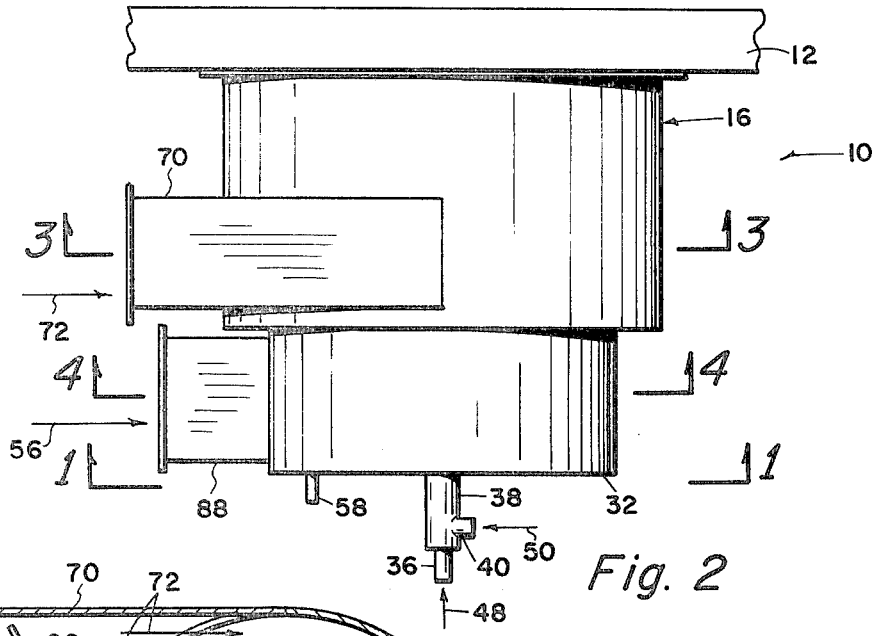
FIG. 2 represents a plan view of the embodiment of FIG. 1.

Referring now to the drawings and, in particular, to FIGS. 1 and 2, there is shown in elevation and plan one embodiment of the invention. The burner system is indicated generally by the numeral 10. There is a first air plenum 14 upstream of a second air plenum 16. These are supplied independently through ducts 88 and 70, respectively, which supply air to the first and second plena, respectively.

Figure 3:
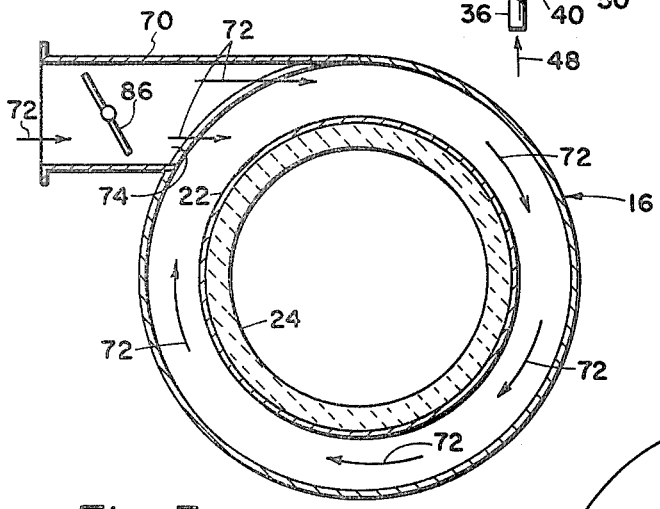
FIGS. 3 and 4 represent cross-sections taken through the embodiment of FIG. 2 along the planes 3—3 and 4—4, respectively.
Figure 4:
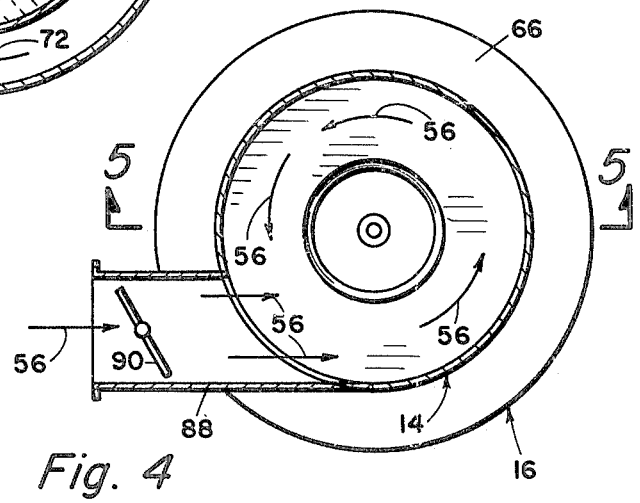

FIGS. 3 and 4 show vertical cross-sections of FIG. 2 taken across the planes 3—3 and 4—4. They show that the primary and secondary air, indicated by arrow 56, flows through the duct 88 into the first plenum 14 in a tangential manner and circles in a counterclockwise direction within that plenum. Similarly, the tertiary air indicated by arrows 72 flows through duct 70 and into the second plenum 16 in a clockwise direction in accordance with arrows 72. Ducts 88 and 70 provide damper or other means 90 and 86, respectively, for control of the total flow of air through the ducts into the first and second plena, respectively.

Figure 5:
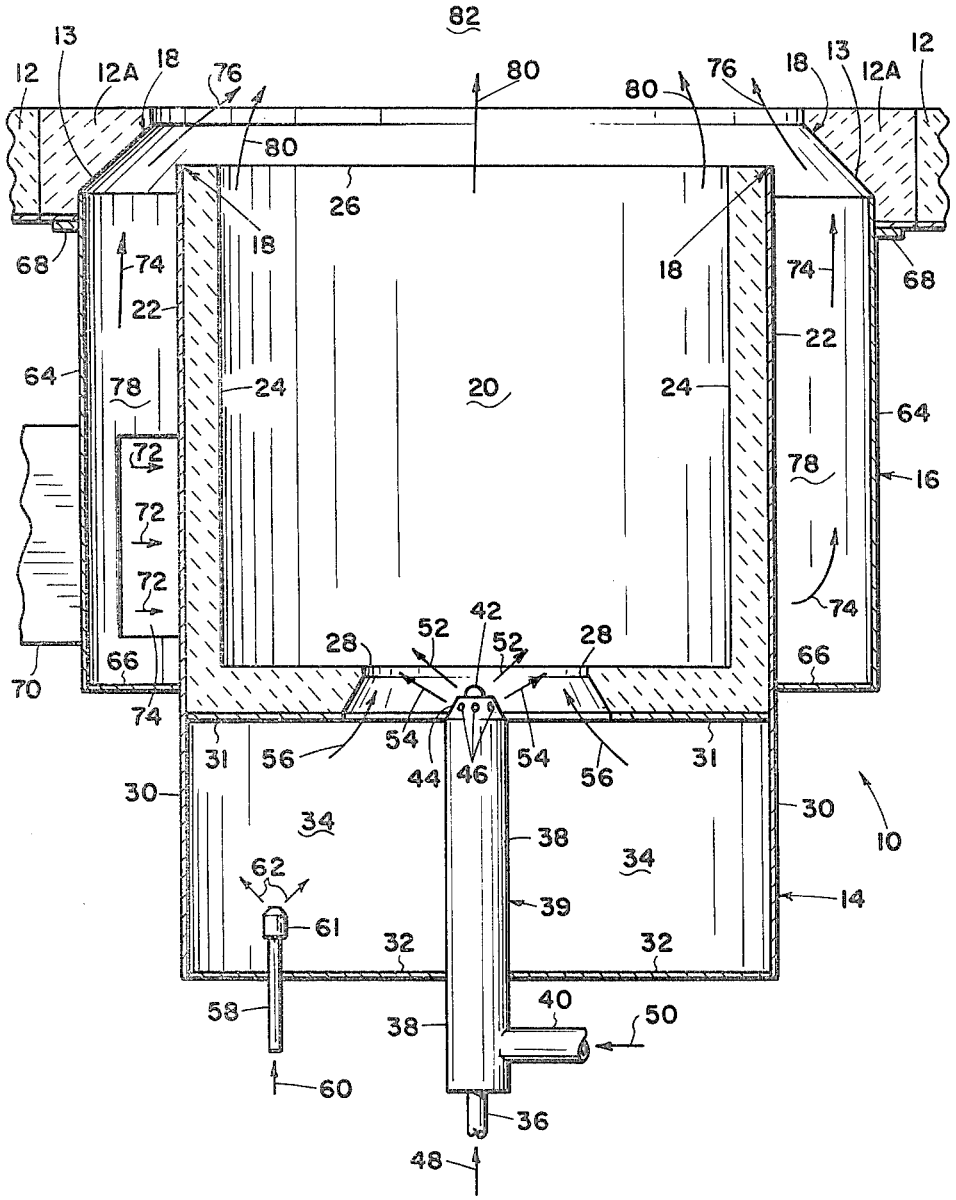
FIG. 5 illustrates, in horizontal cross-section, the embodiment of FIG. 1 taken across the plane 5—5.

Referring now to FIG. 5, there is shown detail of the construction of the embodiment indicated generally by the numeral 10.

There is a first combustion zone, which is enclosed within a cylindrical metal wall 22, lined with refractory material 24, on the sides and on the upstream end, which is enclosed by the annular plate 31. There is a central opening 28 in the plate 31 and the refractory covering of that plate. The purpose of the opening 28 is to permit the injection of fuels from the burner system indicated generally by the numeral 39; also a selected portion of total combustion air 56.

The burner system 39 includes a central tube 36 for supply of liquid fuel under pressure in accordance with arrow 48 to a nozzle 42, which is at the distal end and is positioned within the opening 28. A plurality of small ports is provided in the nozzle 42, through which fine jets of liquid fuel droplets 52 are formed in the shape of a conical sheet.

Surrounding the central tube 36 is an outer tube 38 and has an annular plate closing off the upstream end and a conical plate 44 closing out the downstream end. There is a plurality of circumferentially spaced ports 46, from which jets of gaseous fuel issue under pressure in accordance with arrows 54. The gaseous fuel enters through a side pipe 40 in accordance with arrow 50 and flows down the annular space inside of the outer tube 38 through the ports 46 and into the primary combustion zone 20 in the form of jets arrayed along a conical surface.

An air plenum indicated generally by the numeral 14 is positioned upstream of the wall 31 of the primary combustion zone 20 and includes a cylindrical wall 30 and an end closure plate 32. This air plenum 14 is provided with air through a duct 88 in accordance with arrows 56 as shown in FIG. 1.

Means are provided, such as indicated, for example, by the pipe 58 inserted into the plenum 14, which is supplied with water under pressure in accordance with arrow 60 and has a nozzle 61 with a plurality of ports through which the water is atomized under the high pressure flow through the ports to provide streams of tiny droplets 62, which flow into the air within the plenum and evaporate to provide water vapor, which enters into the chemistry of burning, such that, under conditions of deficient oxygen, a reducing flame situation is formed in the combustion zone 20 in which carbon is burned to form carbon monoxide and water is dissociated to provide hydrogen. With this reducing flame any NOx present, which may have been formed in the combustion within the first combustion zone, will be reduced and the flow of hot products of incomplete combustion carried out within the first combustion zone 20 will flow in accordance with arrows 80 downstream into a second combustion zone 82 downstream of the end 26 of the first combustion zone.

The water atomizer 61 can be positioned in the side of the duct 88, for example, or in the end plate 32 of the first air plenum 14 in the path of the air 56 entering tangentially through the duct 88.

The second air plenum comprises an annular space 78 between the wall 22 of the first combustion zone and the wall 64 of the second air plenum 16. Air enters the second plenum, as shown in FIG. 3, from the duct 70 in accordance with arrows 72 and flows tangentially and in a swirling helical flow in accordance with arrows 72 clockwise within the second plenum 16.

Flow control means 90 and 86, respectively, are provided in the two ducts 88 and 70, which serve the first and second plenum, respectively. These can be of any desired shape and, as indicated in FIG. 1, they can be controlled together by means of rods, or other means, and arms 90A and 86A, respectively, so that they move together and control the flow in both ducts simultaneously so as to vary the total combined flow of air while maintaining a fixed ratio of air flow rate in each of the ducts, or any suitable proportional control arrangement.

On this basis a fixed ratio of combustion air can be supplied to the first plenum and to the second plenum so that a selected ratio to stoichiometric value of air can be supplied in the first combustion zone and a separate fixed ratio of combustion air can be supplied to the second plenum and to the second combustion zone downstream of the first combustion zone.

By combining these two controls in fixed ratio, it is possible to vary the total air supply in accordance with the fuel flow rate or burning rate, while maintaining a selected percentage or ratio to stoichiometric air in the first combustion zone, which is necessary to maintain the low NOx condition.

By means of a control mechanism indicated generally by the numeral 92, a control arm 94 can be provided operated by a shaft 93, which, through means 96, will control the position of the flow controllers 90 and 86 in the ducts 88 and 70, respectively. The control for the box 92 can be by any selected means or can be manual in response to an indication, or controlled by the total flow rate of fuel to be burned or by an analysis of the presence of NOx in the effluent gases, etc.

Referring back to FIG. 5, the second combustion zone 82 is within the furnace and inside the contour of the wall 12. A central tile may be placed within the opening in the walls 12, which has a conical wall 13, which tends to deflect the air flow 74, which is in the form of a helix moving downstreamwardly in the annular space 78. This deflection of the flow 76 causes mixing with the effluent combustible gases 80 to complete the total combustion of the fuel in the zone 82 and with a minimum value of NOx.

In the embodiment described and, regardless of flame consideration, flame within the combustion zone 20, which occurs therein because of the ignition of the fuel 52 or 54 with the primary and secondary air 56 is never supplied with stoichiometric air for the burning of this fuel. The air quantity 56 is never allowed to supply the full oxygen demand for the total fuel to be burned. As a result, the atmosphere within the combustion zone 20 and for some distance downstream of 20 into the zone 82 is "reducing" or "oxygen-free". A number of combustibles, such as hydrogen, carbon monoxide, and other light hydrocarbons, are present. In such an atmosphere, as is well known, the oxides of nitrogen combine with these combustibles at the high temperature within the zone 20 to form carbon dioxide, water and nitrogen, or water and nitrogen. The effluent combustible gases 80 contain either no NOx at all or, at the worst, a few parts per million.

In the reduction of the NOx by combustion with the reducing gases, only a very small part of the additional oxygen demand for complete fuel burning is supplied, so additional air is required. The air supply 56 from the first plenum 14 can be considered as primary air and the air from the second plenum 16 can be considered as tertiary (or final) air, such as is demanded for complete fuel burning, plus a second quantity of excess air.

The primary air 56, in its high velocity swirling motion, meets the high velocity jets 52 and/or 54 of fuel with very great turbulence for very rapid oxidation of fuel within the first combustion chamber 20. However, the meeting of the tertiary air 76 with the effluent gases 80 is at a lesser but controllable turbulence at the periphery of the first combustion zone 20, for much slower burning of the combustible gases 80. Control of this turbulence is needed to avoid reformation of NOx as the tertiary air 76 is supplied to burn the gases 80 for completion of oxidization.

Instead of turbulence being the principle cause for contact and mixture of air 76 with the combustion gases 80, the mechanism deploys diffusion rather than turbulence. Research, which has been repeated many times, verifies that a possible reduction of as much as 60% in NOX emission is available with the type of burner shown in FIG. 5 as compared to a non-specialized fuel burner.

Requirements for fuel burning in point of the shape or proportions of the evolved flame are always known in this stage where the burner and furnace are being designed, and well in advance of actual fuel burning. Therefore, as the burner is designed, it is possible to produce any flame shape or proportions which may be required for the particular service for which the burner is intended. The design features of this invention will be described as they permit choice of the flame shape.

If the requirement is for the shortest (smallest) flame of minimum width, the tangential movements of air within the first and second plena are in opposite directions as shown in FIGS. 1, 2, 3, and 4. The annular discharge area 18 of the second plenum for passage of the tertiary air 76 to meet the gaseous combustibles 80 is selected for the desired flow velocity of 76 toward 80 of at least 65 feet per second.

If greater flame length is preferred, the tangential movement of air within the first and second plena are in the same tangential direction and the area of annular opening 18 is increased so that the air 76 moves toward 80 at approximately 40 feet per second. In FIGS. 3 and 4 the air inlets 88 and 70 are on opposite sides of the axis of the burner, for opposite tangential rotation. For identical tangential rotation the air inlets would be on the same side of the axis of the burner.

For intermediate flame length the tangential movements of air in the first and second plena are in opposite directions but the area of the annular opening 18 for passage of air 76 toward 80 is in the range of 40 feet per second.

The suggestion has been made that the principle means for mixture of the tertiary air 76 with 80 is by diffusion, which is productive of slow mixture. However, the effect of turbulence, that is, quick mixture, is not entirely absent in any case. Turbulence results from gas flow energy which is a function of $MV^2/2$, and a constant Mass as established by the quantity of air flow 76, the flow energy of 76 will vary as the square of its velocity. Thus, and at 65 feet per second versus 40 feet per second there will be 2.6 times more energy for accelerated mixture and turbulence. Also, at 65 feet per second, there is greater penetration of the air supply 76 into the combustible gas flow 80.

Since the hot products of combustion 80 continue to rotate briskly in movement downstream from the wall 31 as the result of tangential movement of the air flow 56 in the space 34, either contra- or co-directional rotation of tertiary air flow 76 after passage through the opening 18 provides additional means for turbulence control. There is greatest turbulence here if 76 and 80 are contra-rotating and least turbulence if 76 and 80 are in co-rotation.

The design of the fuel discharge from the nozzles 42 and 44 is not critical in this embodiment.

Element 58 is indication of a general means for selective addition of steam or water droplet spray to the first air plenum for hydrocarbon-water vapor addition of combustibles to the first combustion zone 20 and the products of combustion 80.

What has been described is an improved burner system for combustion of either or both liquid and gaseous fuels in any desired ratio to provide a minimum NOx in the effluent gases. Means are provided for controlling the air supply so that there is always a selected fraction of stoichiometric air supplied to the first combustion zone in order to control NOx emission while maintaining a variable quantity of total air flow in accordance with the total flow of fuel under various conditions of burning. In this embodiment means are also provided in the design of the burner system for choice of flame shape and size dependent upon the details of construction of the air plena, etc.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element or step thereof is entitled.

It is claimed:

1. A burner system for use of either or both liquid and gaseous fuel for flame control and reduced NOx formation, comprising;

(a) a refractory-lined first combustion zone for burning said fuel with a selected fraction of stoichiometric air;

(b) a first air plenum including an inlet duct for supplying said selected fraction of stoichiometric combustion air upstream of said first combustion zone; including means for imparting a helical motion to said air in a first selected direction of rotation;

(c) means for injecting said fuel axially into the upstream end of said first zone;

(d) a second air plenum surrounding said first combustion zone including an inlet duct for supplying the remaining stoichiometric combustion air downstream of said first combustion zone, and including means for imparting a helical motion to said air in a second selected direction of rotation;

(e) means for passing the hot products of partial combustion in said first combustion zone downstream to a second combustion zone;

(f) means for mixing said air from said second air plenum with said hot products of partial combustion in said second combustion zone;

(g) means in each of said inlet ducts to control the air flow through each in a fixed ratio; and (h) interconnecting means to simultaneously control said air flow to each of said inlets.

2. The burner system as in claim 1 in which said first and second directions of rotation are opposite to each other.

3. The burner system as in claim 1 in which the fuel burner comprises;

(a) a first tube for supplying liquid fuel to a nozzle at the distal end;

(b) a second tube surrounding said first tube, with means to supply gaseous fuel to the annulus between said first and second tube;

(c) an annular wall closing said annular space at said distal end; and (d) a plurality of small ports spaced around said annular wall.

4. The burner system as in claim 1 in which said selected fraction of stoichiometric combustion air is in the range of 60 to 75% of stoichiometric air.

5. The burner system as in claim 1 including means to inject a selected quantity of water in liquid or gaseous form into said first plenum.

* * * * *